US006126976A

United States Patent [19]

Hasse, Jr. et al.

[11] Patent Number: 6,126,976

[45] **Date of Patent: *Oct. 3, 2000**

[54] MICROWAVE POPCORN PACKAGE

[75] Inventors: Glenn W. Hasse, Jr., Northfield; William M. Binole, Burnsville; Jerald L. Johnson, Northfield, all of Minn.

[73] Assignee: Ryt-Way Industries, Inc., Lakeville, Minn.

[ * ] Notice: This patent is subject to a terminal disclaimer.

[21] Appl. No.: 09/400,561

[22] Filed: Sep. 21, 1999

Related U.S. Application Data

[63] Continuation-in-part of application No. 08/902,724, Jul. 30, 1997, Pat. No. 5,985,343.

[60] Provisional application No. 60/101,395, Sep. 22, 1998.

[51] Int. Cl.[7] ..... B65D 85/72

[52] U.S. Cl. ..... 426/107; 426/111; 426/112; 426/113; 426/115; 426/234; 426/241; 426/243; 426/394; 426/395; 219/727

[58] Field of Search ..... 426/107, 111, 426/113, 115, 118, 234, 241, 242, 392, 394, 112, 243; 219/727

[56] References Cited

U.S. PATENT DOCUMENTS

| | | | |
|---|---|---|---|
| 2,673,805 | 3/1954 | Colman | 426/111 |
| 2,673,806 | 3/1954 | Colman | 426/111 X |
| 3,052,554 | 7/1962 | Colman | 426/111 |
| 3,082,906 | 3/1963 | Reed | 426/111 X |
| 3,140,034 | 7/1964 | Wyman et al. | 426/111 X |
| 3,425,845 | 2/1969 | Dunn | 426/111 |
| 3,671,270 | 6/1972 | Jehn | 426/111 |
| 3,782,976 | 1/1974 | Maier et al. | 426/111 X |
| 3,873,738 | 3/1975 | Zoeller et al. | 426/111 |
| 3,969,535 | 7/1976 | Bourns | 426/111 |
| 4,007,285 | 2/1977 | Maier et al. | 426/111 X |
| 4,038,425 | 7/1977 | Brandberg et al. | 426/111 X |
| 4,260,101 | 4/1981 | Webinger | 426/111 X |
| 4,277,506 | 7/1981 | Austin | 426/111 |
| 4,279,933 | 7/1981 | Austin et al. | 426/111 X |
| 4,448,309 | 5/1984 | Roccaforte et al. | 426/111 X |
| 4,453,665 | 6/1984 | Roccarforte et al. | 426/111 X |
| 4,584,202 | 4/1986 | Roccaforte | 426/111 |
| 4,586,649 | 5/1986 | Webinger | 426/111 X |
| 4,734,288 | 3/1988 | Engstrom et al. | 426/107 |
| 5,008,024 | 4/1991 | Watkins | 426/243 X |
| 5,097,107 | 3/1992 | Watkins et al. | 426/243 X |
| 5,214,257 | 5/1993 | Riskey | 426/107 X |
| 5,384,138 | 1/1995 | Robbins, III et al. | 426/111 |
| 5,834,046 | 11/1998 | Turpin et al. | 426/107 |
| 5,985,343 | 11/1999 | Hasse, Jr. et al. | 426/394 |

*Primary Examiner*—Milton Cano
*Attorney, Agent, or Firm*—Dorsey & Whitney LLP

[57] ABSTRACT

A microwave popcorn package including a container having a bottom wall, an open top and a tapered side wall extending from the bottom wall to the open top. The package also includes a variety of lids including a lid which has a substantially planar center portion. The lid is positioned within the container between the bottom wall and the open top to define a popcorn receiving region and to provide a support for the stacking of a plurality of containers. The invention further includes a pouch positioning collar and a method of making and assembling the above package.

19 Claims, 7 Drawing Sheets

MICROWAVE POPCORN PACKAGE

This application claims the benefit of Provisional Application Ser. No. 60/101,395 filed Sep. 22, 1998 and is a continuation-in-part of Ser. No. 08/902,724 filed Jul. 30, 1997 now U.S. Pat. No. 5,985,343.

BACKGROUND OF THE INVENTION

1. Field of the Invention

The present invention relates to a popcorn package, and more particularly to a microwave popcorn package which includes a supply of unpopped popcorn and can be placed in a microwave oven and used substantially in the form in which it is purchased. The invention further relates to a microwave popcorn package where the popped popcorn can be consumed directly from the package and a method of assembling the popcorn package of the present invention.

2. Description of the Prior Art

Numerous expandable food packages currently exist in the prior art for accommodating expandable food products such as microwave popcorn. These packages are designed to both store the popcorn in its uncooked or unpopped condition and to provide a serving container for the popcorn in its popped condition. An early microwave popcorn package comprises an expandable paper bag into which the unpopped popcorn, cooking oils, seasonings etc. are placed. The bag is folded for compact storage and sale. Application of microwave energy causes the popcorn to pop and the bag to expand to contain the product. A further package comprises an expandable cardboard container which is first opened and the popcorn kernels, cooking oils, etc. placed directly into the bottom of the package. A still further prior art package comprises an outer cardboard container in which the unpopped popcorn is contained within a plastic food pouch which is sealed to provide the popcorn with a relativity long shelf life. This permits popcorn to be stored for extended periods of time on grocery store shelves and in inventory without refrigeration. An example of this package is exemplified by Engstrom et al. U.S. Pat. No. 4,734,288.

Tub shaped microwave popcorn packages to simulate popcorn containers at movie theaters also exist and are exemplified by U.S. Pat. Nos. 5,008,024 and 5,097,107 issued to Watkins. These packages are generally tub shaped, with slopping side walls to enable the packages to be stacked during storage, shipment or display. A limitation of the packages described in both of these Watkins patents, however, is the requirement that the flexible cover containing the unpopped popcorn be secured to, and extend downwardly from, the upper open mouth of the container. This results in increased fabrication costs. Increased fabrication costs for these prior art tub containers also result because modified flexible covers and modified production apparatus and methods are required for containers of different sizes.

A tub shaped microwave popcorn package is also shown in the Riskey U.S. Pat. No. 5,214,257 which includes a pop bag containing liquid oil, a heat susceptor adjacent to the tub bottom and a curved lid which flattens out as the popcorn pops to cover the entire open top of the tub. Although Riskey shows the unpopped popcorn evenly distributed across the bottom of the tub, in reality, the pop bag or other popcorn containing pouch can be shifted to one side or the other during handling or shipping. Thus, although the consumer centers the tub in the microwave oven when popping the corn in tubs similar to Riskey, the pop bag is often not centered because it is shifted to one side of the tub. This results in the pop bag not being positioned at the center of microwave heating within the oven.

Accordingly, there is a need in the art for an improved microwave popcorn package, and particularly, an improved, tub shaped microwave popcorn package which facilitates improved production efficiencies and reduced production costs, for packages of the same size as well as packages of differing size as well as improved popping efficiencies.

SUMMARY OF THE INVENTION

In contrast to the prior art, the present invention provides an improved microwave popcorn package, and in particular an improved tub-type microwave popcorn package, which significantly improves the manufacturing efficiencies of the package and thus significantly reduces the production costs and which also more accurately positions the popcorn containing pouch within the tub to increase the microwave heating efficiency.

More specifically, the microwave popcorn package of the present invention comprises a generally tub shaped container of the type having a bottom wall, an open top and a side wall which extends from the bottom wall to the open top. The side wall is tapered outwardly as it extends from the bottom wall to the open top to facilitate the stacking of a plurality of the containers during storage, shipment or display. The package of the present invention further includes a lid or intermediate wall member which is positioned between the open top and the bottom wall to define a popcorn receiving region between the lid and the bottom wall. In one embodiment, the lid is not directly connected with any portion of the container, but is retained in its operative position within the container solely by engagement between its outer peripheral edge and the inner surface of the side wall. In a second embodiment, the lid is retained relative to the inner surface of the side wall at one or more locations by a heat sensitive adhesive. In both of these embodiments, the diametrical dimension of the lid is less than the open top to allow the lid to seat within the tub at a position between the top and bottom edges. In further lid embodiments the outer diametrical dimension can be as large as or larger than the open top, but provided with means to enable the lid to be inserted into the tub below the open top.

A supply of unpopped popcorn is provided in the popcorn receiving region between the lid and the bottom wall. Preferably this supply of unpopped popcorn is provided in a closed pouch which, during storage, shipment and display, is free of any fixed connection with any portion of the container. If desired, a portion of the bottom wall and/or the inner surface of the side wall can be provided with a coating which becomes tacky when exposed to microwave energy to thereby limit the popcorn containing pouch from any shifting during the popping process.

Accordingly, it is an object of the present invention to provide an improved microwave popcorn package, and in particular an improved tub-type popcorn package which overcomes the limitation of the prior art.

Another object of the present invention is to provide an improved tub shaped microwave popcorn package in which the popcorn is supplied in a closed pouch which is free of any connection to the container during storage, shipment or display.

A further object of the present invention is to provide a microwave popcorn package having an intermediate wall member or lid defining a popcorn receiving region which is free of any fixed connection with the container or which is retained relative to the container by a heat sensitive adhesive that is released when the popcorn is popped.

Another object of the present invention is to provide a tub-shaped microwave popcorn package which includes means for more accurately positioning or centering the popcorn containing pouch within the tub container.

A still further object of the present invention is to provide a method of making and/or assembling the improved microwave popcorn package in accordance with the present invention.

These and other objects of the present invention will become apparent with reference to the drawings, the description of the preferred embodiment and the appended claims.

DESCRIPTION OF THE PREFERRED EMBODIMENT

Figure 1:
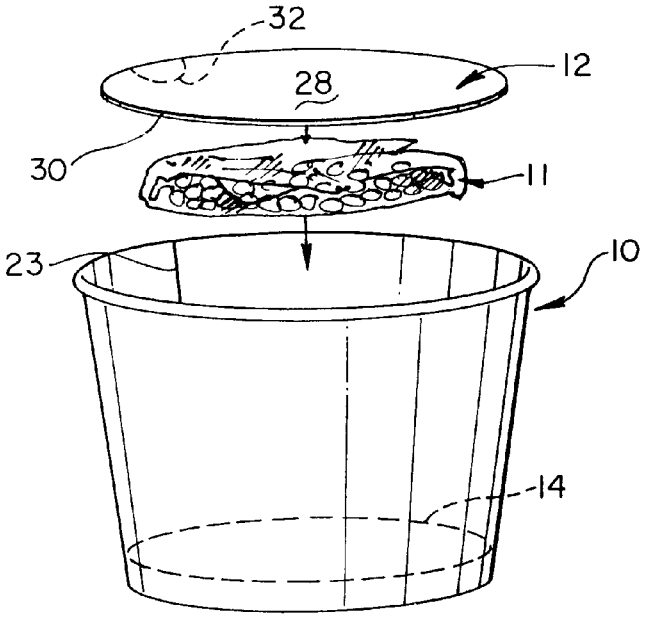
FIG. 1 is an isometric, exploded view of one embodiment of the microwave popcorn package of the present invention with portions illustrated in broken lines.
Figure 2:
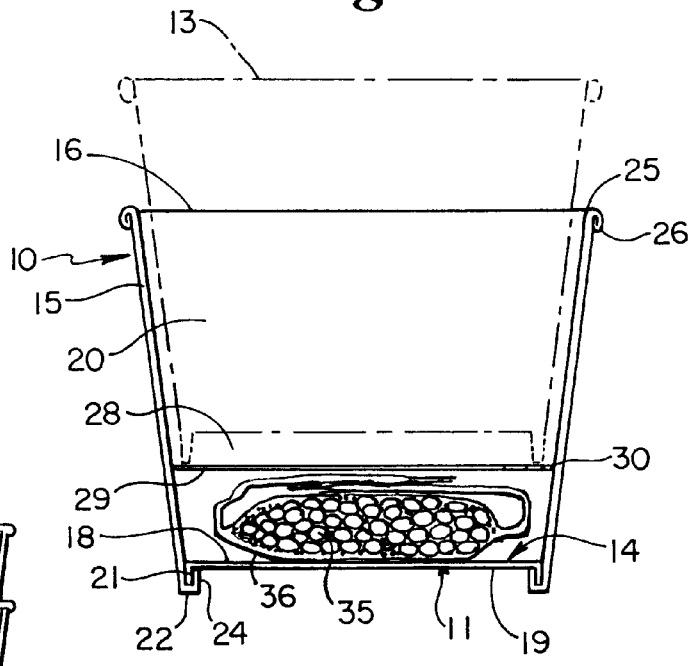
FIG. 2 is a side sectional view of the microwave popcorn package of FIG. 1 and also showing a second container, in phantom, in a stacked relationship relative to the first.
Figure 3:
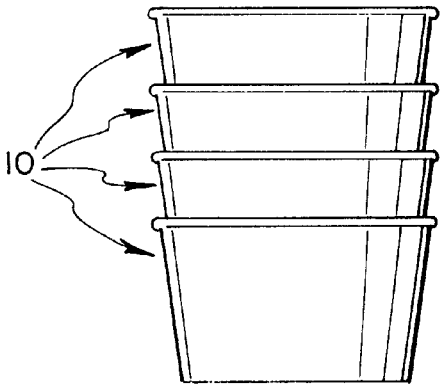
FIG. 3 is a side elevational view showing a plurality of microwave popcorn packages of the present invention in a stacked relationship.

With reference to FIGS. 1 and 2, the microwave popcorn package of the present invention includes a generally tub shaped container 10, a supply of unpopped popcorn 11 and a lid or intermediate wall member 12. The tub shaped container 10 includes a bottom wall 14, an open top 16 and a side wall 15. As illustrated best in FIGS. 1 and 2, the side wall 15 is tapered outwardly from the bottom wall 14 as it extends to the open top 16. This taper enables a plurality of packages to be stacked relative to one another during storage, shipment or display. FIG. 2 illustrates a second container 13 in phantom being stacked relative to the first container 10, while FIG. 3 illustrates four such containers 10 being stacked relative to one another.

The bottom wall 14 in the preferred embodiment has a generally circular peripheral configuration, a top planar surface 18 facing the interior 20 of the container and a bottom planar surface 19 facing a direction opposite that of the container interior 20. A peripheral leg 21 extends downwardly from the outer peripheral edge of the wall 14 for connection with the side wall 15.

The lower end 22 of the side wall 15 includes a portion 24 wrapped around and secured to the leg 21 of the bottom wall 14 as shown best in FIG. 2. This particular tub construction, which includes a side wall seam 23 (FIG. 1), is known in the art. With this construction, the bottom wall 14 is spaced upwardly from the bottom edge 22 for a short distance. This spacing is on the order of ¼ to 1 inch and preferably about ½ inch for a 64 oz. tub.

The side wall 15 terminates at a top edge 25 to define the open top 16. An outwardly curled reinforcing rim 26 is provided at the top edge 25 for providing rigidity to the container 10 and the open top 16. The formation of the rim 26 is known in the art. The side wall 15 includes a tapered inner surface extending from the bottom wall 14 to the top edge 25 and defining the interior 20 of the container 10. The outer surface of the side wall extends from the bottom edge 22 to the top edge 25.

Figure 4:
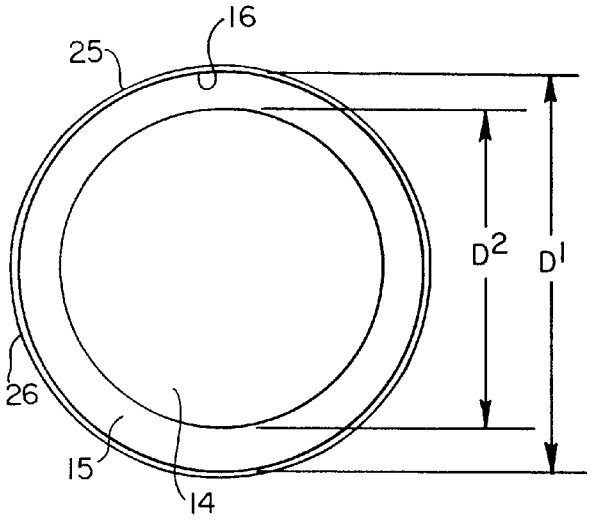
FIG. 4 is a top elevational view of the microwave popcorn package of the present invention without the supply of unpopped popcorn and without the lid.

As illustrated best in FIG. 4, the open top has a generally circular peripheral configuration defined by the top edge 25 of the side wall 15 and has a diametrical dimension $D^1$ greater than the diametrical dimension $D^2$ of the circular peripheral configuration of the bottom wall 14. Because of the differences in the diametrical dimensions $D^1$ and $D^2$ of the open top 16 and the bottom wall 14, respectively, the side wall 15 slopes or tapers outwardly as it extends from the bottom wall 14 to the open top 16. This tapered wall permits adjacent containers to be stacked relative to one another. In the preferred embodiment, the taper angle of the side wall 15 is about 3 to 20 degrees and preferably less than about ten degrees.

In the preferred embodiment, the bottom wall 14 and side wall 15 are constructed of a relativity stiff paper or paper board material which is microwave transparent and is bleached on both sides. It is contemplated, however, that other materials could be used as well. It is also contemplated that the bottom wall 14 and the open top 16 could have configurations other than circular configurations, such as square, rectangular, oval or the like. Preferably, both the bottom wall 14 and the open top 16 have similar or identical peripheral configurations, however, this is not an absolute necessity.

Figure 5:
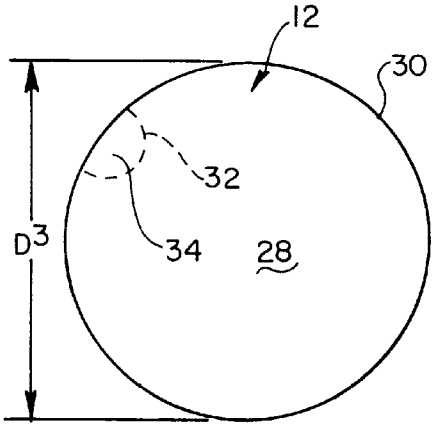
FIG. 5 is an elevational top view of the lid of the microwave popcorn package shown in FIG. 1.

The embodiment of the lid or intermediate wall member 12 of FIGS. 1, 2 and 5 includes a top planar surface 28, a bottom planar surface 29 and an outer peripheral edge 30 defining a peripheral configuration of the lid 12. In the preferred embodiment, the peripheral configuration of the lid 12 is circular and the diametrical dimension $D^3$ (FIG. 5) is less than the diametrical dimension $D^1$ of the open top 16 and greater than the diametrical dimension $D^2$ of the bottom wall 14. This dimensional relationship results in the outer peripheral edge 30 engaging the inner surface of the side wall 15 when the lid 12 is inserted within the interior 20 of the container 10.

As shown best in FIG. 2, insertion of the lid 12 into the container 10 results in the lid 12 being positioned between the bottom wall 14 and the open top 16 to define a popcorn receiving region 31 between the top surface 18 of the bottom wall 14 and the bottom surface 29 of the lid 12. Preferably the dimensions $D^1$, $D^2$ and $D^3$ are such that when the lid 12 is inserted into the container 10, its outer peripheral edge 30 will engage the inner surface of the side wall 15 and be retained at a position which is closer to the bottom wall 14 then the open top 16. The embodiment of the lid 12 is retained in this position solely by engagement between its outer peripheral edge 30 and the inner surface of the side wall 15 and is free of any other connection with the container 10. As illustrated best in FIGS. 2 and 6, the lid 12 maintains its generally planar configuration in its fully inserted position within the tub as well as during its upward movement during the popping process.

When the lid 12 is positioned as shown in FIG. 2, the top surface 28 provides a support surface for an adjacent, stacked container 13. This embodiment of the lid 12 also includes a removal means for manually removing the lid 12 from the container 10, if desired. In the embodiment of FIGS. 1 and 5, this removal means includes the removal opening 32 positioned at the peripheral edge 30 of the lid 12. The removal opening 32 is scored so that the material 34 defined by the score line can be manually removed merely by exerting a force against the material 34 by a finger of the user. Preferably the peripheral configuration of the lid 12 is circular, although it could comprise other shapes as well. Further, it is preferable for the peripheral configuration of the lid 12 to be the same as that of the bottom wall 14 and the open top 16. Certain features of the present invention can, however, still be realized even if the lid 12 has a different peripheral configuration. For example, a polygonal shaped lid such as a hexagon, octagon, etc. can be used with a container having a circular open top.

The lid 12 is preferably constructed of a microwave transparent paper or paper board which has sufficient stiffness to enable it to perform its intended functions, namely, to be retained in the container 10 as a result of engagement between the outer peripheral edge 30 and the side wall 15, to define the popcorn receiving region 31 and to support one or more containers in a stacked configuration as shown in FIGS. 2 and 3. A paper board material having a thickness between 0.02 and 0.04 inches will provide sufficient stiffness for the lid 12 to perform the above functions. Preferably, the lid 12 is bleached on its top side 28, with its bottom side 29 being substantially free of any coatings.

Figure 8:
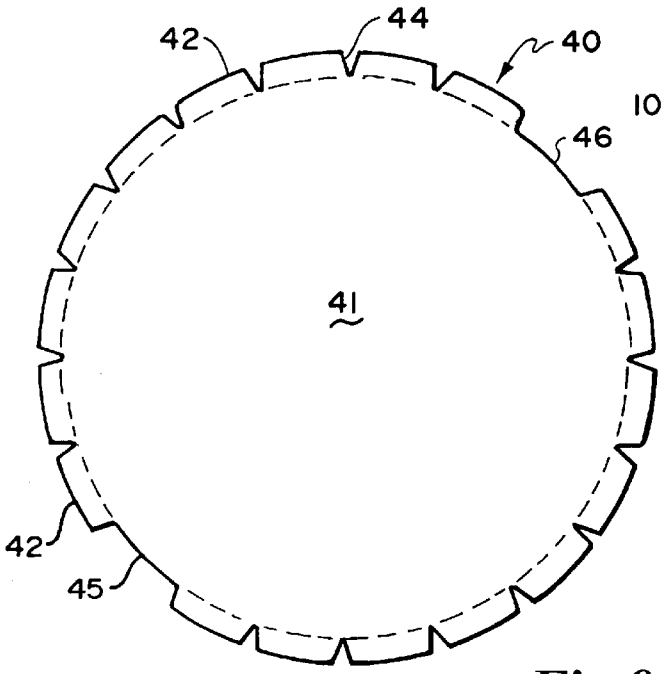
FIG. 8 is an elevational top view of a further embodiment of a lid for the microwave popcorn package of the present invention.
Figure 11:
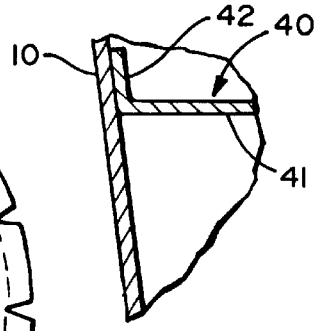
FIG. 11 is a view, partially in section, as viewed along the section line 11—11 of FIG. 9.
Figure 9:
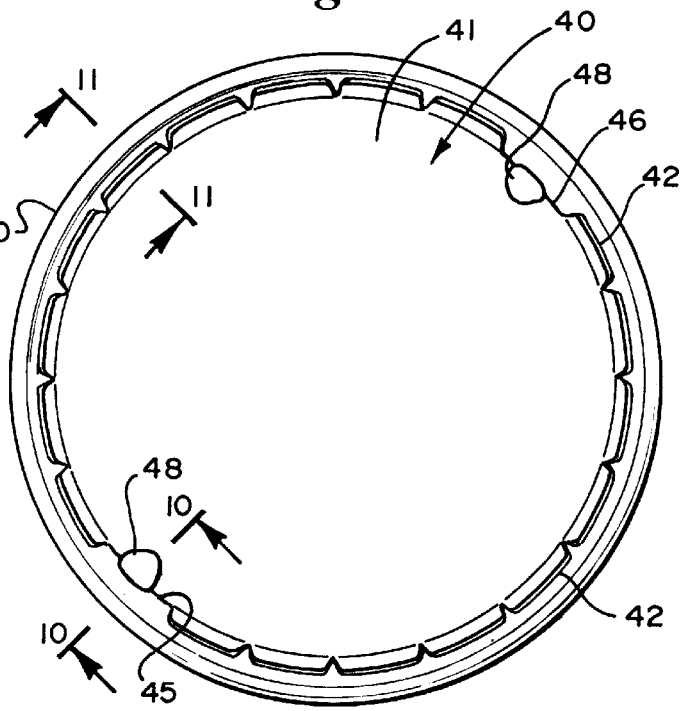
FIG. 9 is an elevational top view of an assembled microwave popcorn package of the present invention with the lid of FIG. 8.

FIG. 8 shows a further embodiment of a lid 40 useable with the microwave popcorn container of the present invention. The embodiment of the lid 40 includes a central lid portion 41 with a circular peripheral edge and a plurality of outwardly extending retaining tabs 42 positioned about the circular peripheral edge. As shown best in FIGS. 9 and 11, the central planar portion 41 has a diametrical dimension less than that of the open top to permit the lid 40 to be inserted into the tub as shown. The tabs 42 are generally trapezoidally shaped and are separated from one other around the peripheral edge by generally triangular shaped openings 43. This permits the tabs to be bent upwardly during insertion of the lid 40 into the container 10 as shown in FIGS. 9 and 11. As shown, the tabs are bent upwardly along the outer peripheral edge of the central lid portion 41.

Figure 10:
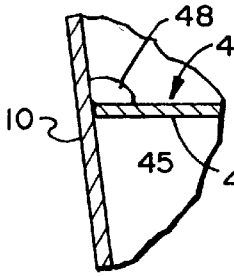
FIG. 10 is a view, partially in section, as viewed along the section line 10—10 of FIG. 9.

As illustrated in FIG. 8 the tabs 42 extend continuously around the entire peripheral edge except at two diametrically opposite locations 45 and 46. As shown best in FIGS. 9 and 10, a drop or bead of heat sensitive adhesive 48 is provided at these points to assist in retaining the lid 40 within the interior of the container 10 and to prevent the lid 40 and the contents within the container from inadvertently falling out or being removed or tampered with prior to use. In the preferred embodiment, the adhesive 48 is a heat sensitive adhesive which, when exposed to microwave energy sufficient to pop popcorn, releases to allow the lid 40 to move upwardly relative to the inner surface of the container 10. The embodiment of FIGS. 8 and 9 contemplate the adhesive 48 being applied at two diametrically opposite locations; however, adhesive 48 may be applied at only a single location or at more than two locations about the periphery of the lid 40. Adhesive may also be used with the lid construction 12 shown in FIGS. 1, 2 and 5, if desired. In place of the one or more drops or beads of adhesive securing the lid to the inner surface of the container 10, it is also contemplated that the lid 12 of FIG. 5 or the lid 40 of FIG. 8 could be continuously secured to the inner surface of the container 10 by a heat sensitive adhesive around the entire peripheral edge of the lids 12 or 40.

Figure 12:
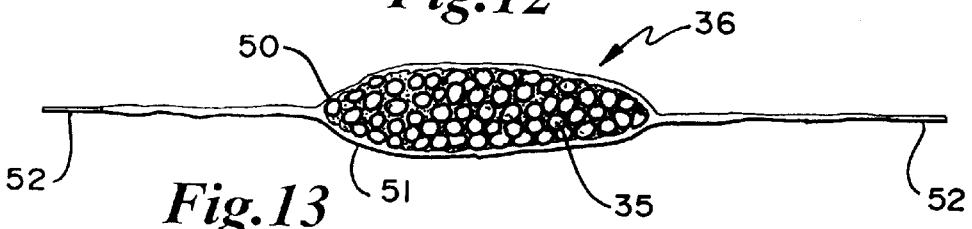
FIG. 12 is a side elevational view, partially in section, of the popcorn supply pouch usable with the package of the present invention.

Positioned within the popcorn receiving region 31 as best shown in FIG. 2, is a supply of unpopped popcorn 35. It is preferred for this unpopped popcorn 35 to be contained within a closed or sealed pouch 36 together with the popping oil, salt and other seasonings. Preferably the pouch 36 is an expandable pouch constructed of a film material which is substantially impermeable to oxygen and moisture so that it is capable of maintaining the freshness of the contained popcorn, oil and seasonings for a commercially acceptable period of time. The construction of the pouch 36 in accordance with the present invention is similar to that of the pouch disclosed in U.S. Pat. No. 4,734,288, the substance of which is incorporated herein by reference. As shown best in FIG. 12, the pouch 36 is comprised of a top film layer 50 and a bottom film layer 51 which are sealed along their outer peripheral edges 52. The central portion of the pouch is provided with unpopped popcorn 35 and the oils and seasonings for popping the popcorn. Preferably the pouch 36 is free of any connection to the bottom wall, the side wall or any other part of the container prior to use, i.e., during storage, shipment or display.

Figure 7:
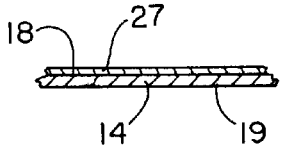
FIG. 7 is a fragmentary sectional view of a portion of the bottom wall showing a coating thereon.

If desired, all or a portion of the top surface 18 of the bottom wall 14 and all or a portion of the inner surface of the side wall 15 may be coated with a material which is solid at room temperature and which, when exposed to microwave energy sufficient to pop the popcorn, softens and becomes tacky. This in turn results in portions of the pouch 36 fusing or sticking to this tacky coating. This prevents the pouch 36 from shifting within the container 10 during the popping process or while the popcorn is being consumed. An example showing such a coating 27 on the top surface of the bottom wall 14 is shown in FIG. 7. The details of such a coating are fully described in U.S. Pat. No. 4,734,288, the substance of which is incorporated herein by reference.

Figure 13:
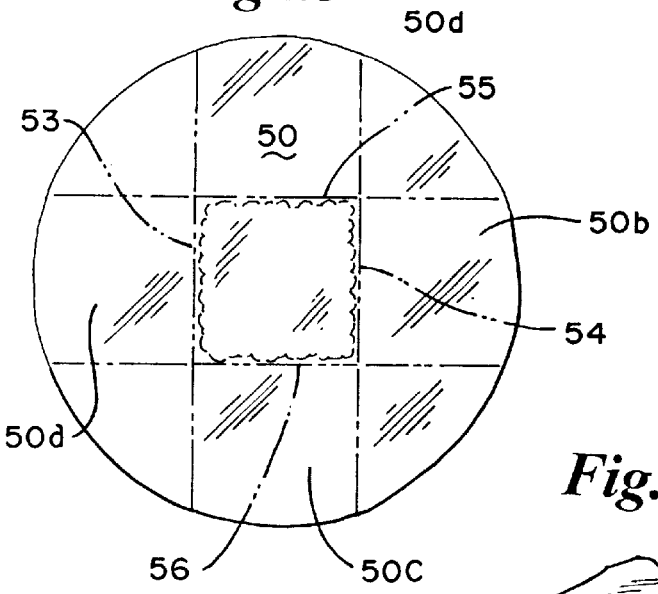
FIG. 13 is an elevational plan view of the popcorn supply pouch showing pouch fold lines.
Figure 14:
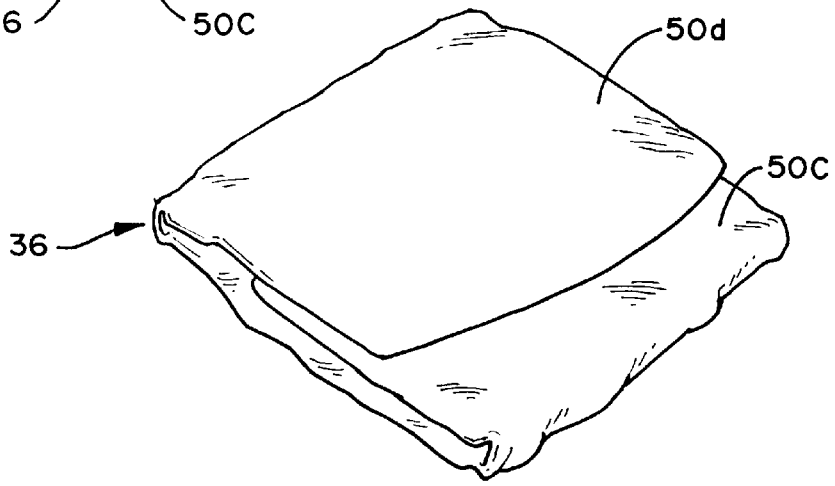
FIG. 14 is an isometric view showing the pouch in its folded position for placement in the tub.

Prior to the placement of the pouch 36 into the container 10, it is preferable for the outer portions of the pouch to be folded inwardly and toward the open top in the manner shown in FIGS. 13 and 14. In FIG. 13, the outer portions 50*a* and 50*b* are first folded inwardly along the fold lines 53 and 54. Next, the outer portions 50*c* and 50*d* are folded inwardly along the fold lines 55 and 56. This results in a folded pouch as shown in FIG. 14.

Folding the outer portions of the pouch 36 inwardly and toward the open top prior to placement in the container 10 accomplishes several things. First, it prevents the top film layer 50 from prematurely contacting and sticking to the side wall 15 during the popping process. Secondly, it causes the bottom film layer 51 to contact and stick to the side wall 15 at a higher position, resulting in a fuller looking container when the popping process is complete. Thirdly, folding the outer portions of the pouch inwardly and toward the open top facilitates the lid 12 rising more evenly. It is not required for the pouch to be folded exactly as shown and described in FIGS. 13 and 14. However, it is preferable for the outer edges or portions of the pouch be folded or gathered inwardly and toward the open top prior to placement in the container 10.

The method aspect of the present invention includes providing a tub shaped container having a bottom wall, an open top and an outwardly tapered side wall extending between the bottom wall and the open top and further providing an intermediate wall member or lid having a peripheral configuration and dimensions which enable it to be inserted into the container and retained in a position between the bottom wall and the open top. Still further method steps include introducing a sealed, expandable pouch containing unpopped popcorn into the container so that it rests on the bottom wall 14 and inserting the lid into the container so that it engages the side wall and is maintained in a position above the popcorn. Prior to placement of the pouch into the container, it is preferably folded as described above. In one embodiment of the present invention, the pouch and the lid are free of any fixed connection with the container during storage, shipping or display. In a second embodiment, one or more beads of adhesive, or a continuous strip of adhesive, are provided about the peripheral edge of the lids 12 or 40 to secure the same to the inner surface of the container 10.

Figure 6:
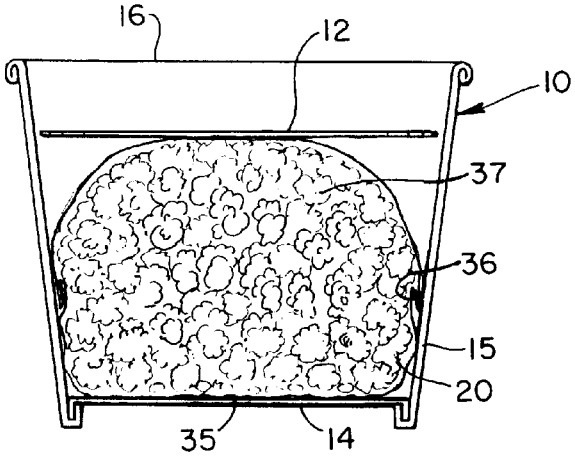
FIG. 6 is a side sectional view similar to that of FIG. 2 with the popcorn partially popped.

FIG. 6 illustrates the package of the present invention during the microwave corn popping process. When it is desired to pop popcorn using the package of the present invention, the package, with the pouch 36 and the lid positioned as shown in FIG. 2 are placed into a microwave oven. It is not necessary to remove the lid 12 prior to popping. In fact, if the lid 12 or 40 is glued to the container 10, it is intended that the lid not be removed prior to cooking. During cooking and popping of the popcorn, the lid 12 or 40 will merely rise upwardly through the container 10 as the popcorn is popped as shown in FIG. 6.

Figure 15:
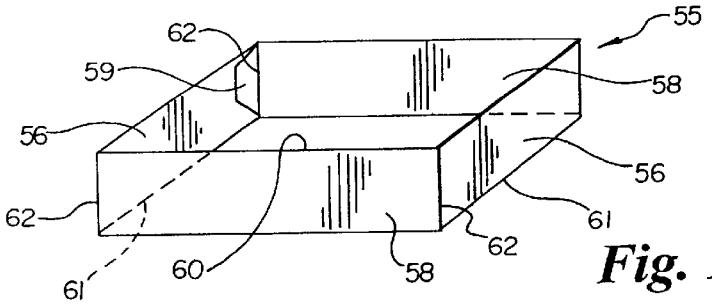
FIG. 15 is an isometric view of a pouch supporting collar for use with the popcorn package of the present invention.

During transport or handling of the tub shaped packages, the popcorn containing pouch 36 can shift to one side of the tub or the other, so that its bottom film is not fully engaged with the bottom 14 of the tub. This can result in inefficient popping if the microwave energy is not fully centered or focused on the popcorn within the pouch 36. Further, handling or dropping of the tub, particularly when several tubs are stacked together, often results in an unsupported lid such as that shown in FIG. 2 being forced toward the bottom 14 of the tub. In some cases, the lid can be wedged into the tub with sufficient force so that the popping of the popcorn is not sufficient to remove it. Accordingly, a further feature of the present invention includes the provision of a means positioned in the bottom interior of the popcorn tub to ensure accurate positioning of the popcorn containing pouch and to support a plurality of tubs to prevent the lid from wedging against the tub interior. Such means also causes the pouch to engage the sidewalls of the tub at a higher position, thus resulting in a fuller-looking container when the popping process is complete. In the preferred embodiment as shown in FIG. 15, this means 55 includes a generally rectangular shaped support and positioning collar having a first pair of opposing sidewalls 56,56 and a pair of second opposing sidewalls 58,58. The sidewalls 58,58 and 56,56 are joined to the ends of one another at the corners 62 as shown. Preferably, the collar 55 is formed from a single length or strip of material with bend lines to define the corners 62 and with an end tab 59 glued or otherwise connected to the opposite end of the strip. The collar 55 defines a closed loop configuration and includes a continuous bottom edge 61, a continuous top edge 60, an open top and an open bottom.

Figure 16:
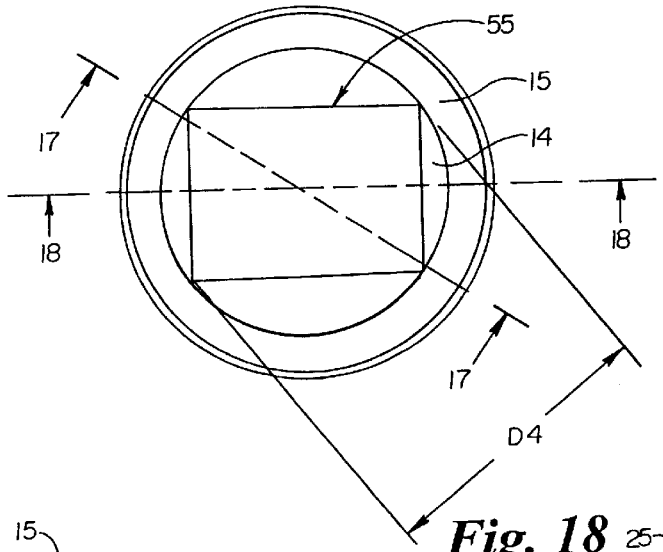
FIG. 16 is an elevational plan view of the popcorn package of the present invention with the pouch supporting collar positioned within the tub.
Figure 17:
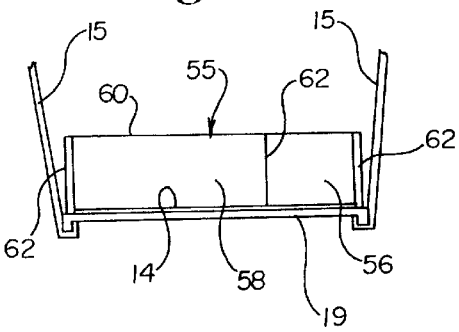
FIG. 17 is a view, partially in section, as viewed along the section line 17—17 of FIG. 16.
Figure 18:
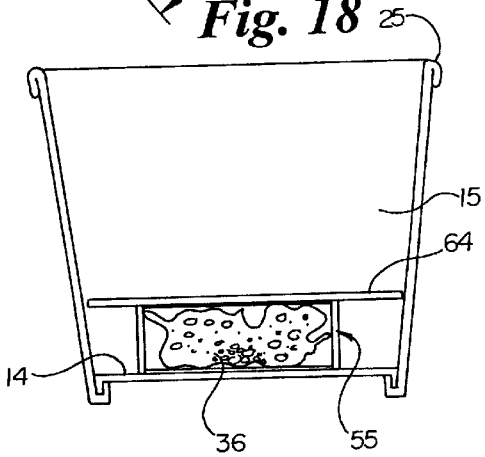
FIG. 18 is a view, partially in section, as viewed along the section line 18—18 of FIG. 16 and containing a pouch within the supporting collar.

As shown best in FIGS. 16, 17 and 18, the collar 55 is inserted into a popcorn tub as shown with the bottom edge 61 engaging the tub bottom 14. The dimensions of the collar 54 are such that its greatest diametrical dimension $D_4$ as shown in FIG. 16 is approximately equal to, but no greater than, the dimension $D_2$ (FIG. 4) of the bottom 14 of the tub. Thus, when the collar 55 is inserted, the corners 62 are in close proximity with, if not in engaging, at least a portion of the sidewall 15 of the tub. When in this position, the collar 55 remains relatively stationary within the tub during transport, handling.

The collar 55 includes a height dimension defined as the distance between the bottom edge 61 and the top edge 60. This height dimension defines the distance which the free standing collar extends above the bottom 14 of the tub when the collar is inserted. Preferably this height dimension should be sufficiently high to fully enclose and contain the popcorn containing pouch 36 within the collar 55 as shown in FIG. 8. Further, because the top edge 60 may also function at least partially to support the lid 64, the height dimension should be sufficient to perform that function and to also support a plurality of other stacked containers at a desired spacing as shown. In the embodiment of FIGS. 16–18 in which the collar 55 is used to assist in supporting the lid 64, the lid 64 does not necessarily need to be retained in position between the bottom wall 14 and the top edge 25 of the tub as a result of engagement between the edges of the lid and the sidewalls 15 as in the embodiment of FIG. 2. In the embodiment of FIG. 18, the lid 64 is generally planer and has an outer diametrical dimension less than that of the open top; however, if desired, it can also have a diametrical dimension less than that of the tub bottom 14.

The collar 55 is preferably constructed of a cardboard, paperboard, or other material which is of sufficient rigidity or strength to perform its primary functions of containing the popcorn pouch 36 during shipping and handling and supporting the lid 64 and a plurality of stacked tubs. The collar 55 should also preferably be transparent or substantially transparent to microwave energy and as lightweight as possible to reduce costs, while still being sufficiently strong to perform its primary functions.

Figure 19A:
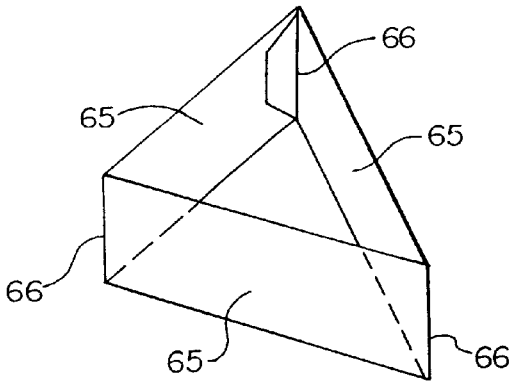
FIGS. 19A, 19B, 19C and 19D show various alternate embodiments of the positioning and support collar for use in a microwave popcorn tub in accordance with the present invention.

The collar in accordance with the preferred embodiment is a generally rectangular configuration; however, it is contemplated that a variety of other configurations could be utilized as well. For example, FIGS. 19A, 19B, 19C and 19D show various alternate configurations. Specifically, FIG. 19A is a generally triangular configuration having three sides 65 and three corners 66. The size of this configuration is preferably such that when the configuration is inserted into the open top of the tub, the corners 66 will be in close proximity, or engaging, the sidewalls of the tub. Preferably, however, the size is such that the collar of FIG. 19 can be inserted so that its bottom edge rests on the bottom wall of the tub.

Figure 19B:
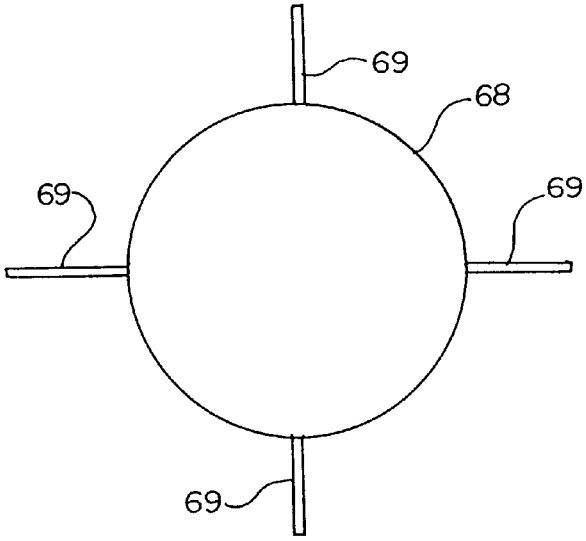

The configuration of FIG. 19B includes a generally circular sidewall 68 and a plurality of spokes 69 extending radially outward from an outer surface of the sidewall 68. The configuration of FIG. 19B is intended to be inserted into the tub so that the outer edges of the spokes 19 engage or are in close proximity to the sidewall of the tub and the bottom edge of the collar rests on the bottom wall of the tub when inserted.

Figure 19C:
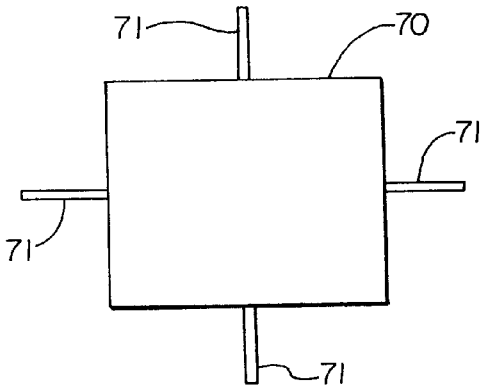

The configuration of FIG. 19C is similar to that of FIG. 19B except that it includes a generally square wall configuration 70 with a plurality of spokes 71 extending outwardly from the sides of the wall 70 for engagement or positioning in close proximity to the sidewall of the tub. It is contemplated that the shape of the sidewall can be any shape desired including polygons with a number of sidewalls greater than four. Similarly, the shape of the lid 64 can be other than circular and in fact can have any number of sides and corners in the embodiment shown in FIG. 18 as long as it is capable of being supported by the collar and includes edge or corner portions sufficient to support the bottom edge of a stacked tub.

Figure 19D:
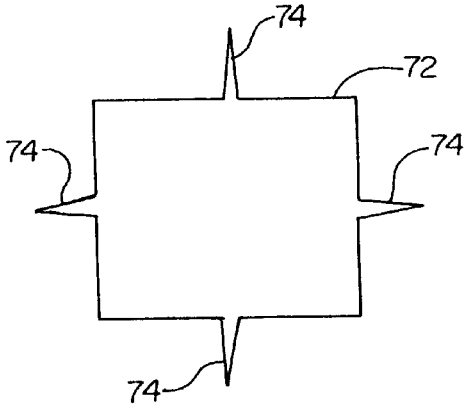

FIG. 19D is also a generally square configuration having a generally square sidewall 72 and a plurality of outwardly extending spokes 74. In the embodiments of FIGS. 19B and 19C, it is contemplated that the spokes 69 and 71, respectively, would be secured to the outer edges of the sidewall by an adhesive or the like. In the embodiment of FIG. 19D, however, the collar is formed of a continuous strip of material in which the spokes 74 are formed by bending a portion of the material outwardly and the bending it back again on itself. The shape of the sidewall in the configuration 19D can take on virtually any configuration including that of a circle, an oval, or a multi-sided configuration. In all of the embodiments of FIGS. 19A–19D, it is contemplated that the internal size of the collar would be of a size to sufficiently contain the popcorn pouch 36 and prevent it from shifting during handling or shipment and would have a height dimension sufficient to support a lid and one or more stacked tubs at a desired height.

Figure 20:
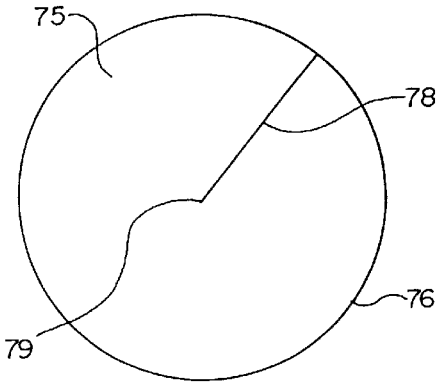
FIG. 20 is an elevational plan view of a further embodiment of the package lid for use in the popcorn package of the present invention.
Figure 21:
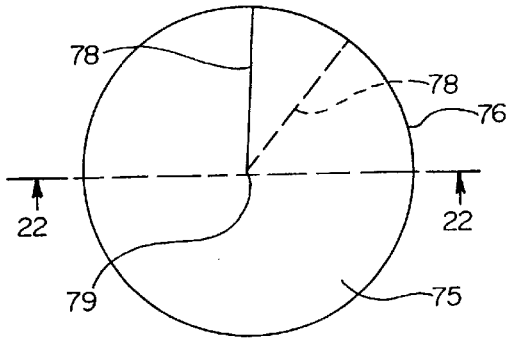
FIG. 21 is an elevational plan view of the lid of FIG. 20 with a portion overlapped to decrease the diametrical dimension of its outer edge.

A further embodiment of a lid configuration usable in the microwave popcorn package of the present invention is illustrated in FIGS. 20–23. Unlike the lid 28 shown in FIG. 5 which is substantially planer and maintains that planer configuration throughout its insertion into the tub, the lid 75 is a lid configuration which does not necessarily need to have an outer diametrical dimension less than that of the open top. In fact, it may be the same as that of the open top or in some cases even greater. In the embodiment of FIG. 20, the lid 75 is a thin piece of paperboard or cardboard having an outer, generally circular edge 76 which conforms substantially to the shape of the tub configuration and a diagonal cut or slit 78. In the preferred embodiment, the slit 78 is a generally radially extending slit extending from the outer edge 76 to approximately the center 79 of the lid. This slit 78 enables one of the edges defined by the slit to be overlapped relative to a portion of the lid to a position such as that illustrated in FIG. 21. When this is done, the diametrical dimension of the outer edge 76 decreases in size. As the outer diametrical dimension decreases, the lid 75 begins to form a generally conical configuration similar to that shown in FIG. 22.

Figure 23:
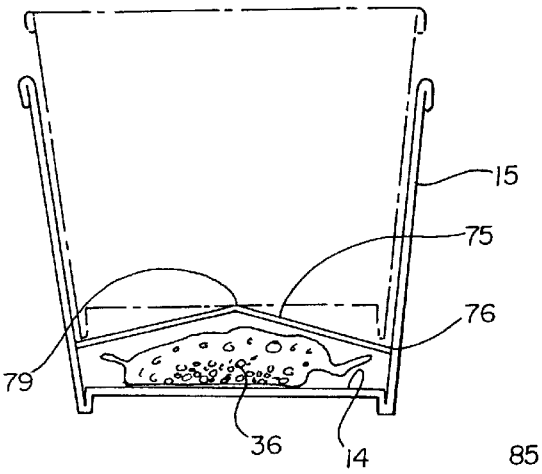
FIG. 23 shows a pair of microwave packages in a stacked relationship and utilizing the lid embodiment of FIGS. 20–22.
Figure 22:
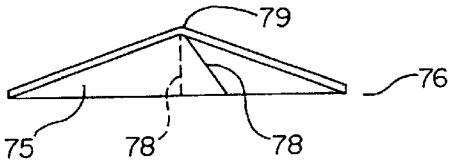
FIG. 22 is a view, partially in section, as viewed along the section line 22—22 of FIG. 21.

By overlapping portions of the lid 75 in the area of the slit 78, the outer diametrical dimension of the lid 75 can be sufficiently decreased so that it can be inserted into the tub into a position such as that shown in FIG. 23. In this position, the outer edge 76 engages the inner surface of the sidewalls 15 of the tub and the top surface of the lid 75 provides a supporting surface for one or more stacked tubs. Although the embodiment of the lid of FIGS. 20–23 shows a single radial cut 78, it is contemplated that a second radial cut may also be made. This would necessarily result in a triangular or pie-shaped piece of the lid 75 being removed. However, such configuration would facilitate decreasing an outer diametrical dimension of the lid 75 for insertion into the tub.

Figure 24:
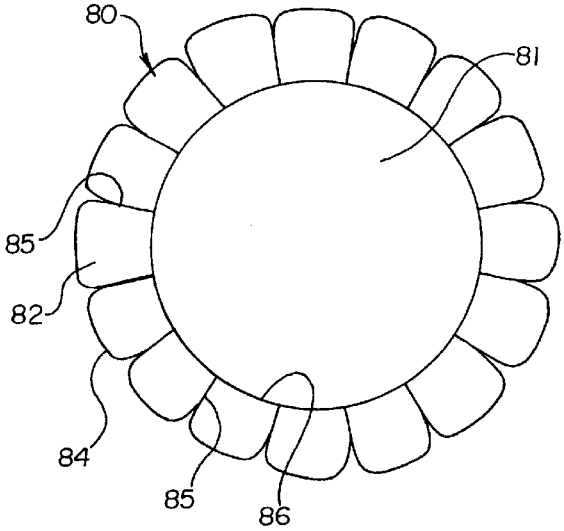
FIG. 24 is a elevational plan view of a still further embodiment of a lid configuration for use with the popcorn package of the present invention.
Figure 25:
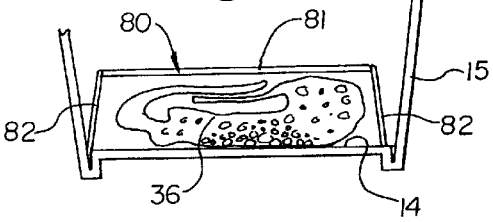
FIG. 25 is a side sectional view of a microwave popcorn package of the present invention utilizing the lid configuration of FIG. 24.

A still further configuration of a lid for use with a microwave tub in accordance with the present invention is shown in FIGS. 24 and 25. This further lid embodiment 80 includes a centrally positioned planer portion 81 and a plurality of circumferentially positioned tabs or petals positioned around the planer center 81. Each of the tabs 82 is defined by an outer edge 84 and a pair of side edges 85. The tabs 82 are bent downwardly relative to the planer section 81 along the fold line 86. When inserted within the tub as shown in FIG. 25, the planer surface 81 forms a support surface for one or more stacked tubs and the tabs 82 extend downwardly for engagement with the bottom 14 of the tub. In this position, the portion 81 is supported by the tabs 82 at a fixed or desired distance above the bottom 14 of the tub.

If preferred, any of the lid embodiments shown, including the lid embodiments of FIGS. 20–25 can be additionally secured by a heat sensitive adhesive which is releasable when exposed to microwave energy. Further, it is contemplated that any of the lid embodiments can be utilized in combination with a support and positioning collar such as the collars shown in FIGS. 15–19, or can be used separately, without such a collar. It is also contemplated that the collar can be utilized either with or without a lid. Although a lid is highly preferred to keep the popcorn pouch 36 from falling out and to provide tamper evident means, it is possible for the upper edge of the collar to provide a direct support for one or more stacked tubs.

Although the description of the preferred embodiment has been quite specific, it is contemplated that various modifications could be made without deviating from the spirit of the present invention. Accordingly, it is intended that the present invention be dictated by the appended claims rather than by the description of the preferred embodiment.

What is claimed is:

1. A microwave popcorn package comprising:

a container having a bottom wall, an open top and a tapered side wall extending from said bottom wall to said open top, said side wall being tapered outwardly from said bottom wall toward said open top to facilitate stacking of a plurality of said containers;

a lid positioned between said open top and said bottom wall to define a popcorn receiving region between said lid and said bottom wall; and a lid support having a bottom edge engaging said bottom wall and a top edge supporting said lid between said open top and said bottom wall.

2. The microwave popcorn package of claim 1 wherein said lid has a diametrical dimension less than said open top.

3. The microwave popcorn package of claim 1 wherein said lid support includes a wall portion spaced inwardly from said side wall.

4. The microwave popcorn package of claim 3 wherein said lid support included portions closely adjacent to said side wall.

5. The microwave popcorn package of claim 1 wherein said lid support comprises a closed loop configuration.

6. The microwave popcorn package of claim 5 wherein said lid support comprises a rectangular configuration.

7. The microwave popcorn package of claim 1 wherein said lid support includes a wall portion and a popcorn containing pouch confined by said wall portion.

8. The microwave popcorn package of claim 7 wherein said wall portion is a closed loop wall portion.

9. The microwave popcorn package of claim 1 wherein said lid support comprises a closed loop collar.

10. The microwave popcorn package of claim 1 wherein said supply of unpopped popcorn includes a closed pouch containing unpopped popcorn.

11. The microwave popcorn package of claim 10 wherein said closed pouch is expandable and is free of any fixed connection to said container.

12. A microwave popcorn package comprising:

a container having a bottom wall, an open top and a tapered side wall extending from said bottom wall to said open top, said side wall being tapered outwardly from said bottom wall toward said open top to facilitate stacking of a plurality of said containers;

a lid positioned between said open top and said bottom wall to define a popcorn receiving region between said lid and said bottom wall, said lid having a peripheral edge and a diametrical dimension less than said open top and being retained in its position between said open top and said bottom wall by adhesive applied at one or more locations between said peripheral edge and said container side wall.

13. The microwave popcorn package of claim 12 wherein said adhesive is a heat sensitive adhesive which releases upon application of microwave energy sufficient to pop popcorn.

14. A microwave popcorn package comprising:

a container having a bottom wall, an open top and a tapered side wall extending from said bottom wall to said open top, said side wall being tapered outwardly from said bottom wall toward said open top to facilitate stacking of a plurality of said containers and a lid positioned between said open top and said bottom wall to define a popcorn receiving region between said lid and said bottom wall, wherein said lid includes a peripheral edge, a center and a cut extending from said peripheral edge to said center.

15. The microwave popcorn package of claim 14 including a supply of unpopped popcorn in said popcorn receiving region.

16. The microwave popcorn package of claim 15 wherein said supply of unpopped popcorn includes a closed pouch containing unpopped popcorn.

17. A microwave popcorn package comprising:

a container having a bottom wall, an open top and a tapered side wall extending from said bottom wall to said open top, said side wall being tapered outwardly from said bottom wall toward said open top to facilitate stacking of a plurality of said containers and a lid positioned between said open top and said bottom wall to define a popcorn receiving region between said lid and said bottom wall wherein said lid includes a central portion with a diametrical dimension less than that of said open top and a peripheral edge, said lid further including a plurality of support tabs extending outwardly from said peripheral edge, said tabs engaging said bottom wall.

18. The microwave popcorn package of claim 17 including a supply of unpopped popcorn in said popcorn receiving region.

19. The microwave popcorn package of claim 18 wherein said supply of unpopped popcorn includes a closed pouch containing unpopped popcorn.

* * * * *